US007097569B2

(12) United States Patent
Brobeck

(10) Patent No.: US 7,097,569 B2
(45) Date of Patent: Aug. 29, 2006

(54) RESTORABLE SAND OR PELLET PILE DEVICE

(76) Inventor: William I. Brobeck, 1125 Bollinger Canyon Rd., Moraga, CA (US) 94556

( * ) Notice: Subject to any disclaimer, the term of this patent is extended or adjusted under 35 U.S.C. 154(b) by 508 days.

(21) Appl. No.: 10/118,649

(22) Filed: Apr. 8, 2002

(65) Prior Publication Data

US 2003/0027647 A1 Feb. 6, 2003

Related U.S. Application Data

(63) Continuation-in-part of application No. 09/861,042, filed on May 17, 2001, now abandoned.
(60) Provisional application No. 60/205,618, filed on May 18, 2000.

(51) Int. Cl.
*A63G 31/00* (2006.01)

(52) U.S. Cl. ..... 472/126; 417/900; 417/395; 417/510

(58) Field of Classification Search ..... 472/126; 417/900, 395, 507, 510, 570
See application file for complete search history.

(56) References Cited

U.S. PATENT DOCUMENTS 3,454,272 A * 7/1969 Rekow et al. ..... 472/126
3,908,865 A * 9/1975 Day ..... 222/135
3,914,074 A * 10/1975 Bille ..... 417/516
4,057,244 A * 11/1977 Gaspar ..... 472/126
4,343,394 A * 8/1982 Emmert et al. ..... 198/550.6
4,439,200 A * 3/1984 Meyer et al. ..... 406/99
4,887,400 A * 12/1989 Carroll ..... 52/195
5,269,827 A * 12/1993 Lenke et al. ..... 65/178
5,782,617 A * 7/1998 Habla ..... 417/395
5,928,086 A * 7/1999 Strickland ..... 472/126
5,967,704 A * 10/1999 Cipriani ..... 406/85

* cited by examiner

*Primary Examiner*—Kien T. Nguyen
(74) *Attorney, Agent, or Firm*—Bruce H. Johnsonbaugh

(57) ABSTRACT

A restorable sand or pellet pile is provided for use as an amusement or exercise device. A sand or pellet collection chamber has inclined side walls that converge toward each other in a downward direction and having a bottom surface connected to the side walls. A support deck is positioned above the side walls of the collection chamber and is adapted to support sand or pellets on its upper surface. A safety grating is formed around the perimeter of the support deck to allow sand or pellets to flow downwardly therethrough into the collection chamber as children or adults play or exercise on the pile. A diaphragm pump is positioned in the collection chamber and pumps sand upwardly through a vertically extending conduit to restore the pile. The pump may be operated intermittently or continuously. Other pumping mechanisms may be used. The preferred embodiment utilizes resilient inclined side walls in the collection chamber and a vibrator connected to the side walls to cause the side walls to vibrate. The vibration causes the sand or pellets to become fluidized and flow more easily into the intake of the pump.

22 Claims, 22 Drawing Sheets

RESTORABLE SAND OR PELLET PILE DEVICE

CROSS-REFERENCE TO RELATED APPLICATION

This application is a continuation-in-part of U.S. nonprovisional application Ser. No. 09/861,042 filed May 17, 2001 now abandoned. This application also claims the benefit of and priority from U.S. provisional application Serial No. 60/205,618 filed May 18, 2000.

BACKGROUND AND SUMMARY OF INVENTION

The present invention relates generally to amusement devices and to training/exercise devices. More particularly, the present invention provides in one embodiment a restorable sand pile for use by children in which the sand is automatically collected as the pile becomes worn down and expands outwardly. The outwardly expanding sand drops downwardly through a perimeter grating and into a collection hopper. A pumping system periodically or continuously restores the sand pile to a conical shape. The present invention is capable of using materials other than sand for a restorable pile for use as an amusement device. One embodiment of the invention includes a diaphragm pump capable of pumping dry sand upwardly. The restorable sand pile may also be used for exercise or training purposes. For example, the user can run up the pile as it is being restored for cardiovascular and leg exercise.

Various devices are known in the prior art for conveying and lifting sand and other similar particulate materials that behave similar to a fluid. For example, U.S. Pat. No. 4,343,394 to Emmert et al teaches an apparatus for elevating fluent materials such as grain, sand or concrete onto a conveyor. The device utilizes a vertical auger working in conjunction with an elevated conveyor. There is no teaching or suggestion in Emmert of creating a rebuildable or restorable pile for use as an amusement or exercise device. The Carroll U.S. Pat. No. 4,887,400 teaches a granular material storage system. This system utilizes a rather complex mechanism for creating a conical storage pile for grain. This patent does not teach or suggest reconstituting a conical pile of materials for use as an amusement or exercise device. The Cipriani U.S. Pat. No. 5,967,704 teaches a pneumatic system for conveying granular material. Again, this patent does not teach or suggest a restorable conical pile of fluent material which is usable as an amusement or exercise device.

The present invention provides for the first time a sand or pellet pile for use as an amusement or exercise device which, in its preferred form, is automatically restorable. The present invention provides a system which can also be transportable to a site, such as a birthday party or other special occasion, in which a sand or pellet pile would be an attraction. The present invention includes a variety of built-in safety mechanisms and a relatively simple but, yet, rugged design capable of withstanding intensive use by children. Applicant believes this is the first mechanism ever for providing a mechanically and/or automatically restorable sand or pellet pile for use by children of all ages as an amusement or exercise device. The present invention provides, in its preferred embodiment, a diaphragm pump capable of pumping dry sand upwardly. The applicant believes this is the first pump capable of pumping dry sand in an upward direction.

A primary object of the invention is to provide an amusement device wherein a sand pile or pellet pile is automatically or mechanically restorable to a conical shape and which allows continuous use by children and/or adults.

A further object of the invention is to provide a conical pile of material, such as sand or pellets, for use as an amusement or exercise device which is automatically restorable to a conical shape.

Another object of the invention is to provide a simple but rugged design for a restorable sand pile, for example, capable of withstanding continuous use by children and/or adults.

Yet another object of the invention is to provide a transportable amusement or exercise device which includes an automatically or mechanically restorable conical pile of sand or other fluent material.

A further object of the invention is to provide a diaphragm pump capable of pumping dry sand either vertically upwards or upwardly at an angle.

Another object of the invention is to provide a sand collection hopper with tapered side walls wherein said tapered side walls are agitated or vibrated in order to fluidize said sand to cause the sand to flow more easily into the pump mechanism.

Other objects and advantages of the invention will become apparent from the following description and the drawings wherein:

DETAILED DESCRIPTION OF THE DRAWINGS

Figure 1:
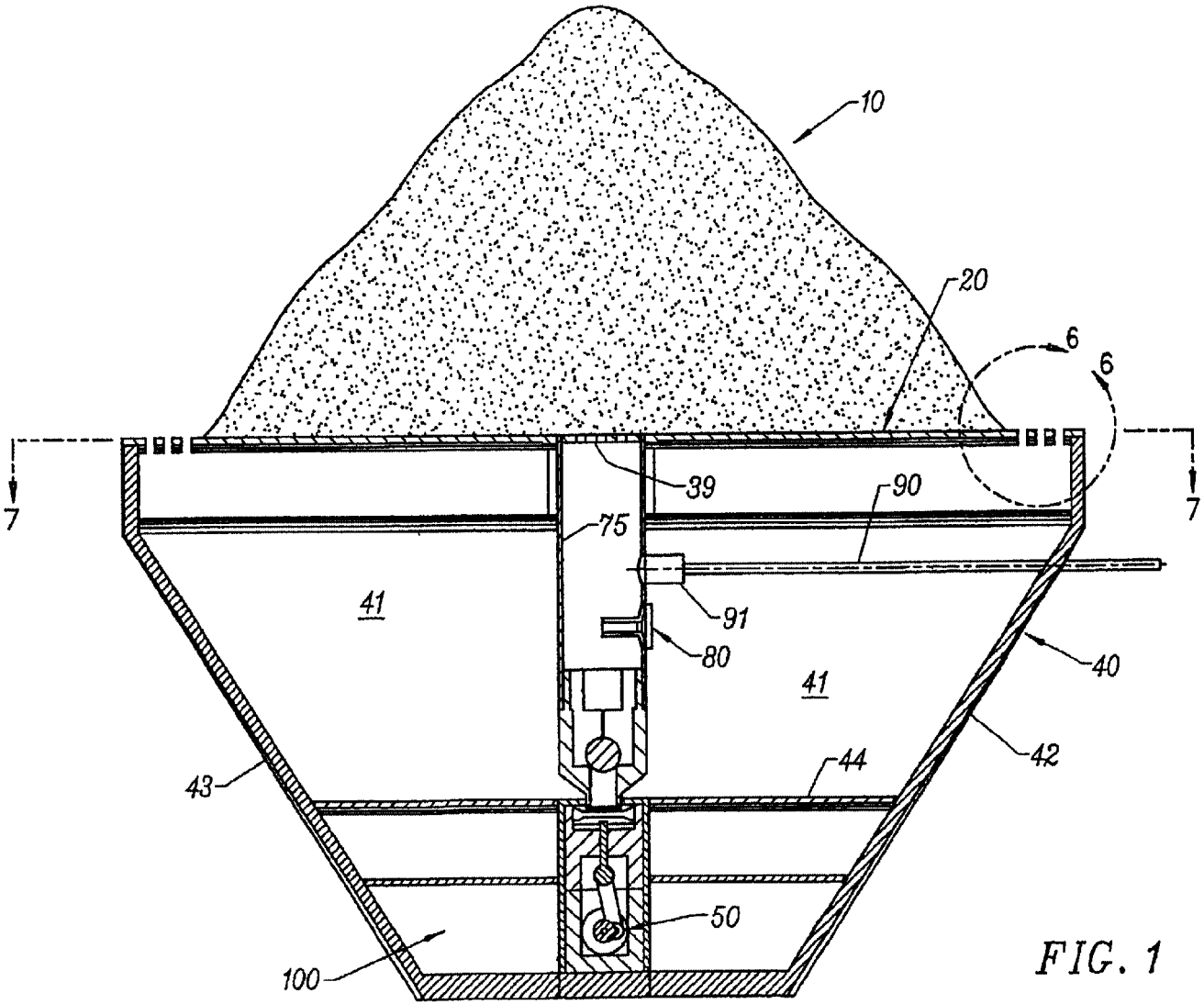
FIG. 1 is a schematic representation showing the present invention and a conical pile of sand or other fluent material available for use by children as an amusement or exercise device.
Figure 2:
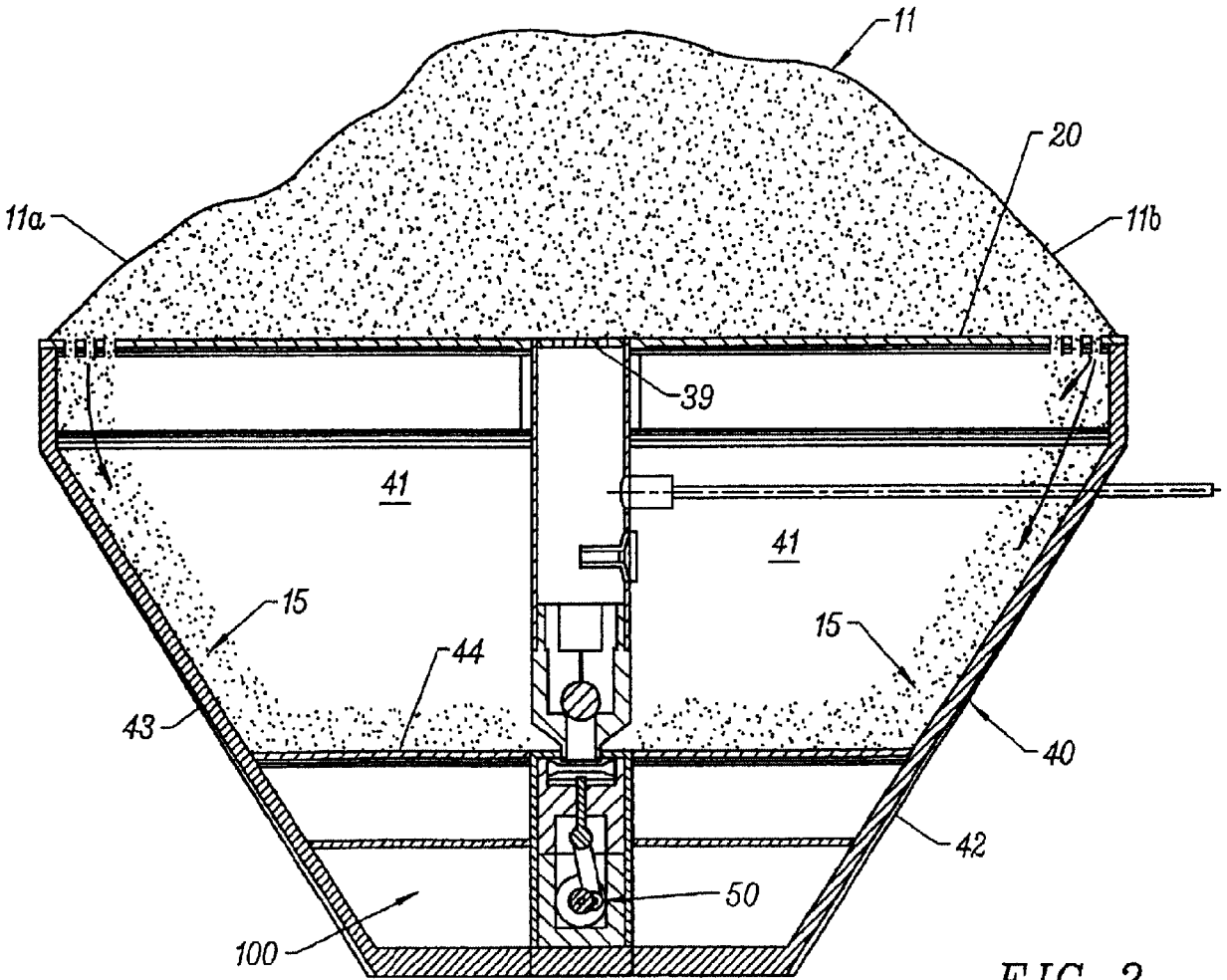
FIG. 2 is a schematic representation of the device of FIG. 1 showing how the conical pile tends to expand outwardly and wherein the outermost region of sand falls through a perimeter grating and into the collection hopper or cavity.

FIGS. 1–5 are schematic representations showing one manner of operation of the present invention in which a sand pile 10 is positioned on a circular support deck 20. The following description is limited to sand, for the sake of brevity, but it is to be understood the invention is usable with pellets and other particulate matter. FIG. 2 illustrates schematically how children or adults playing or exercising on the sand pile reduce the size of the sand pile to that shown as 11 in FIG. 2 wherein the sides of the sand pile 11*a* and 11*b* extend radially outwardly from the center of the pile and flow through an open grating 30 formed in deck 20 as described in greater detail below. The sand passing through grating 30 begins to accumulate in sand or pellet collection chamber 41 beneath support deck 20. The accumulating sand in collection chamber 41 is illustrated as 15. Collection chamber 41 is formed by a hopper 40 having tapered side walls 42 and 43 and a flat bottom 44 as shown in FIG. 2. Side walls 42 and 43 converge toward each other in a downward direction. Support deck 20 is positioned above collection chamber 41. In the embodiment illustrated in FIGS. 1–5, the configuration of hopper 40 is an inverted, truncated cone having walls 42 and 43 and bottom horizontal floor 44. A separate and lower chamber 100 is formed below sand cavity floor 44 which houses a diaphragm pump 50 described in greater detail below.

Figure 3:
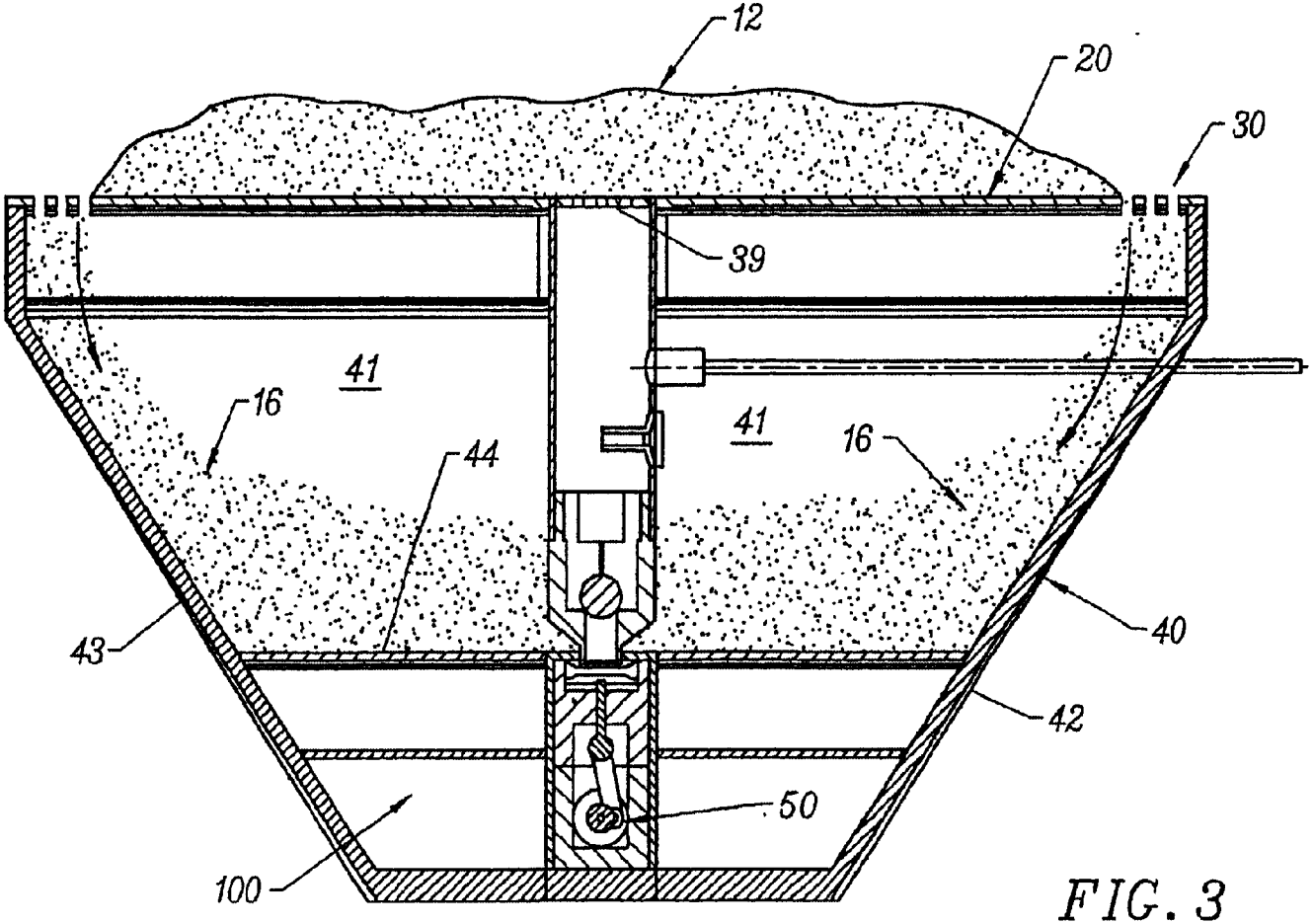
FIG. 3 is a schematic representation of the device of FIGS. 1 and 2 showing the pile at its lowermost size and wherein most of the sand or other fluent material has been collected in the collection hopper or cavity.

As shown in FIG. 3, the sand pile has been reduced to its smallest configuration 12 on top of support deck 20 and the sand collected within sand collection chamber 41 has increased to its maximum volume illustrated as 16.

Figure 4:
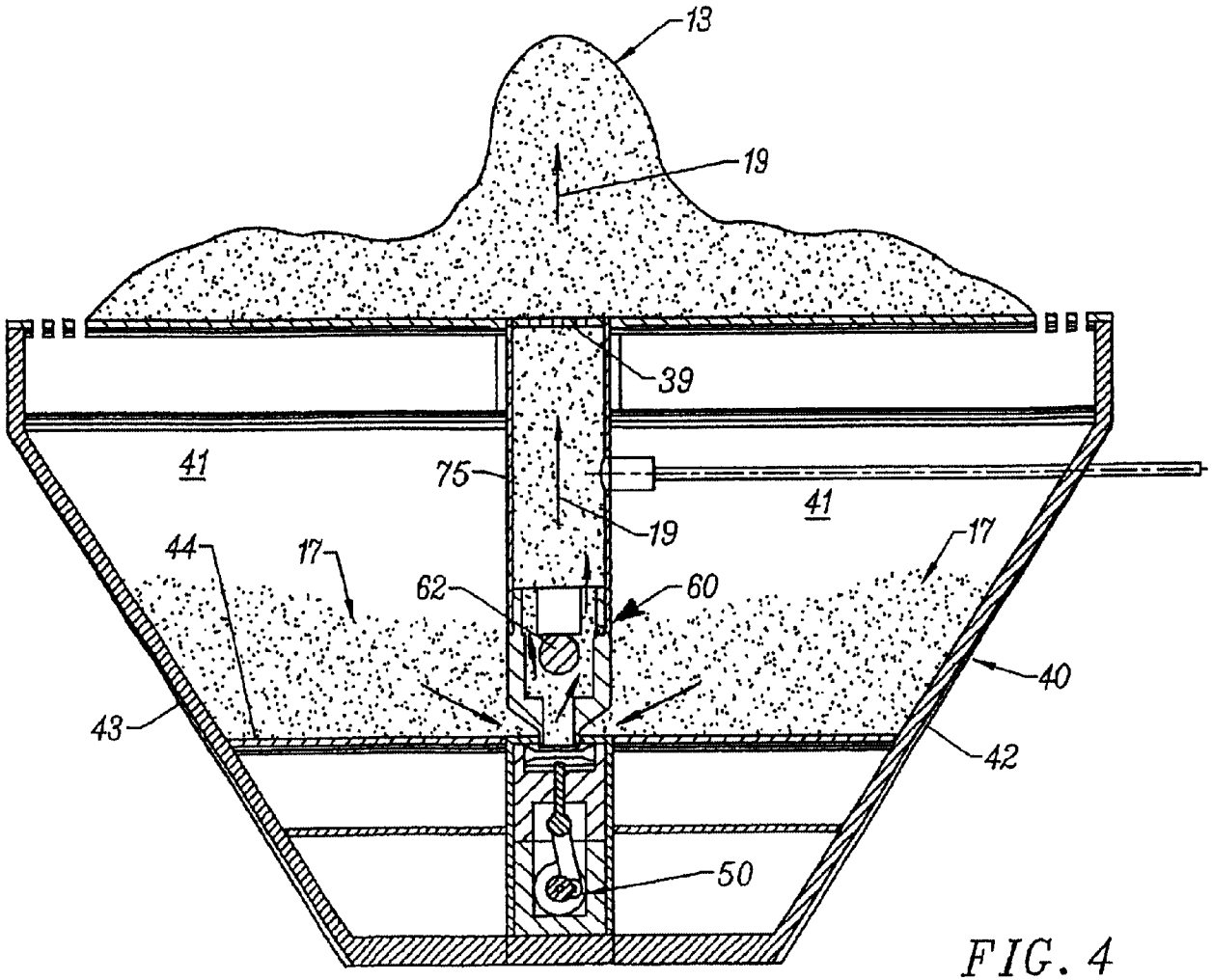
FIG. 4 is a schematic representation of the device of FIGS. 1–3 showing the sand being pumped upwardly by a diaphragm pump through a central conduit and wherein the conical pile is in the process of being restored.

As shown in FIG. 4, diaphragm pump 50 has been actuated and ball valve 60 is shown with ball 62 in its open position in which sand from collection chamber 41 is pumped upwardly as shown by arrows 19 to begin restoring the sand pile which is shown in FIG. 4 as partially restored sand pile 13.

Figure 5:
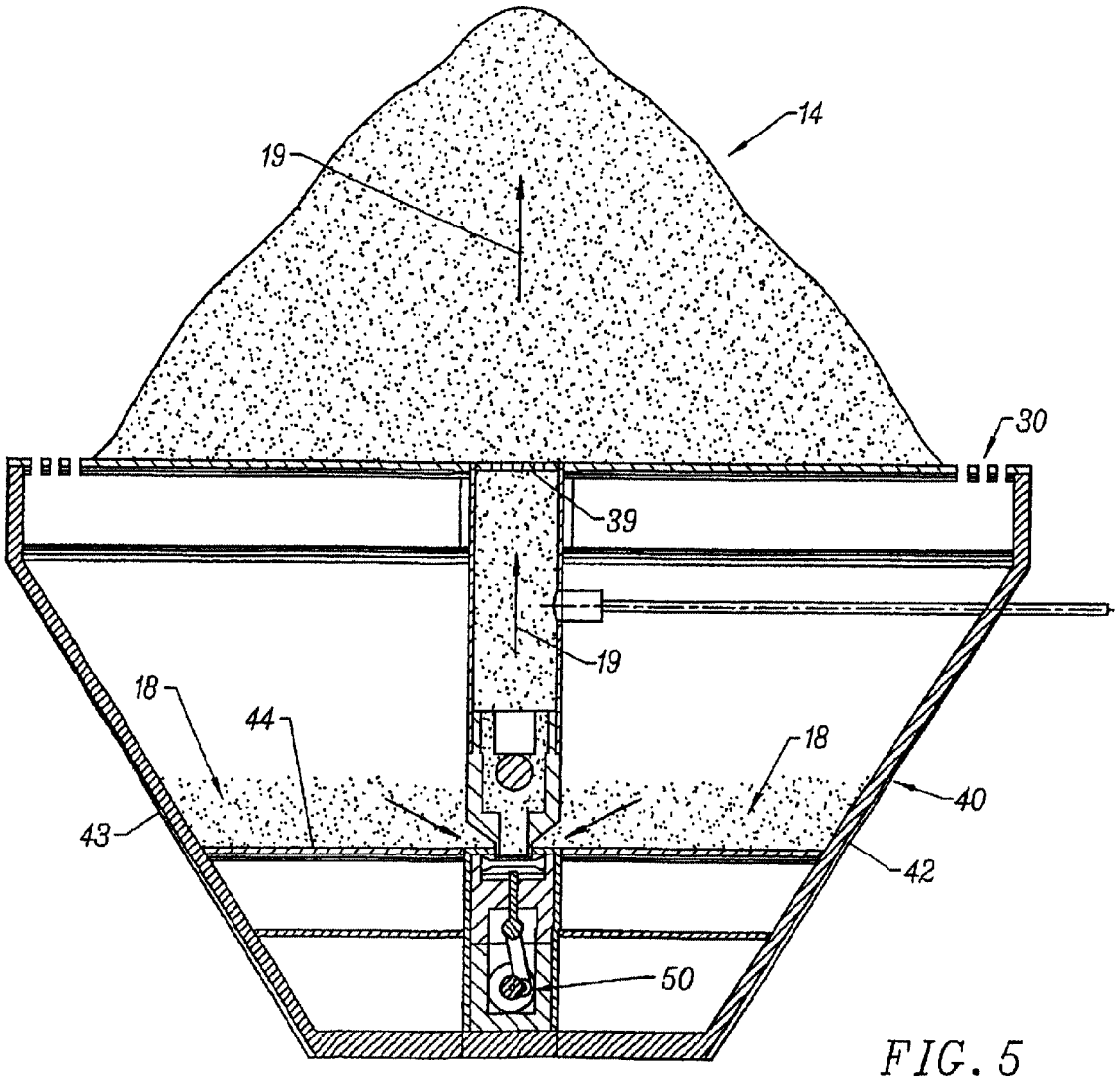
FIG. 5 is a schematic representation of the device of FIGS. 1–4 showing a continuation of restoration of the pile and wherein most of the fluent material collected in the hopper has been pumped upwardly and the conical pile has been restored to its fullest height.

FIG. 5 illustrates the sand pile 14 as it approaches its fully restored position illustrated in FIG. 1. The general path of sand pumped upwardly by diaphragm pump 50 is shown by arrows 19. Once the sand pile has been restored to its original conical form shown in FIG. 1, diaphragm pump automatically shuts down and the cycle repeats itself.

Although FIGS. 1–5 show an intermittent operation of diaphragm pump 50, it is also within the scope of the invention to allow the diaphragm pump 50 or other pump to operate continuously. For example, a vertical auger or other pumping mechanism could be utilized to restore the pile. A second alternate embodiment of a diaphragm pump is shown in FIGS. 10–17 and described below. The intermittent operation illustrated in FIGS. 1–5 is simply an example of one mode of operation of the invention. It is also within the scope of the invention to utilize an "on demand" pump which becomes automatically activated when sand or other fluent material reaches a predetermined level in sand collection cavity 41.

Any particulate matter may be utilized. For example, gravel may be used; in addition, objects of various shapes and sizes made of plastic or other materials may be utilized. The word "pellets" is used herein and in the claims in its broadest possible sense and is used to include all of the aforementioned materials.

Figure 6:
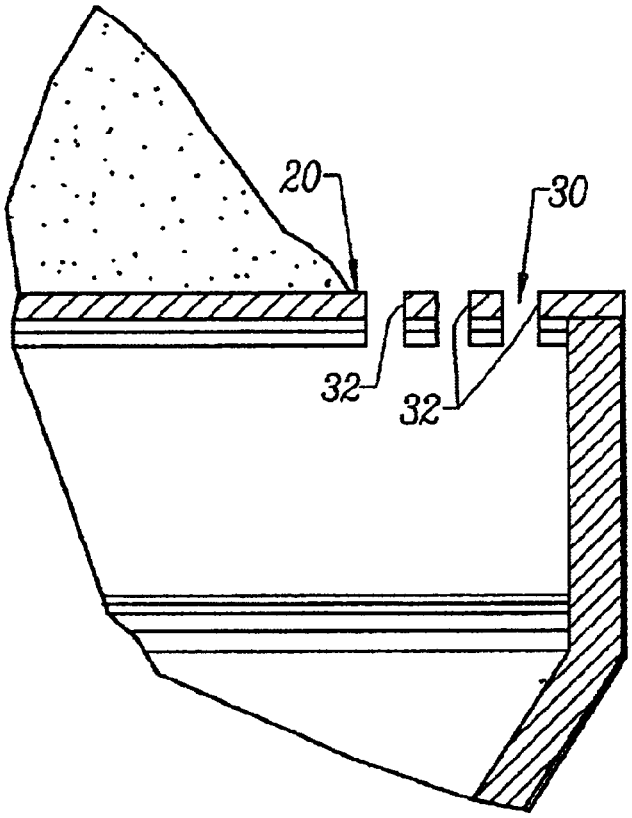
FIG. 6 is an cross-sectional view of a portion of FIG. 1 showing in greater detail the perimeter collection grating.

FIG. 6 shows in greater detail how the slotted openings 32 of safety grating 30 allow sand or other fluent material to flow through perimeter grating 30 formed in support deck 20. The safety grating 30 is designed to allow sand or pellets to flow freely therethrough but also to prevent users from being able to reach through the grating or lift up the grating.

Figure 7:
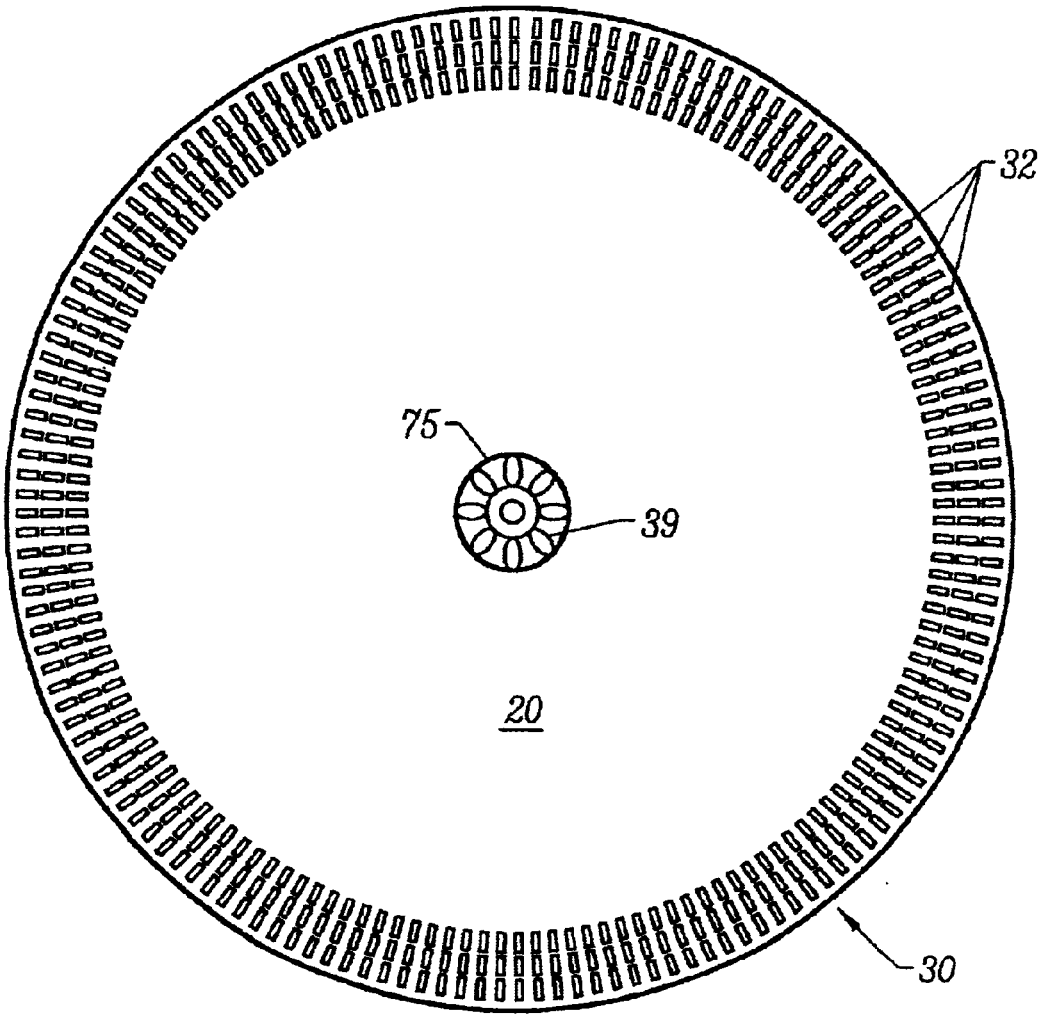
FIG. 7 is a plan view on the lines 7—7 of FIG. 1 showing the sand support deck and the perimeter grating.

FIG. 7 is a plan view of support deck 20 and the perimeter safety grating 30 formed in deck 20. Perimeter grating 30 has a plurality of slotted openings 32 formed therein to allow sand or other fluent material to flow therethrough and into the sand collection chamber 41. FIG. 7 also illustrates the central vertical conduit 75 through which sand is pumped by diaphragm pump 50 upwardly through an opening in the center of deck 20. The top of conduit 75 is a circular section of safety grating 39.

Figure 8:
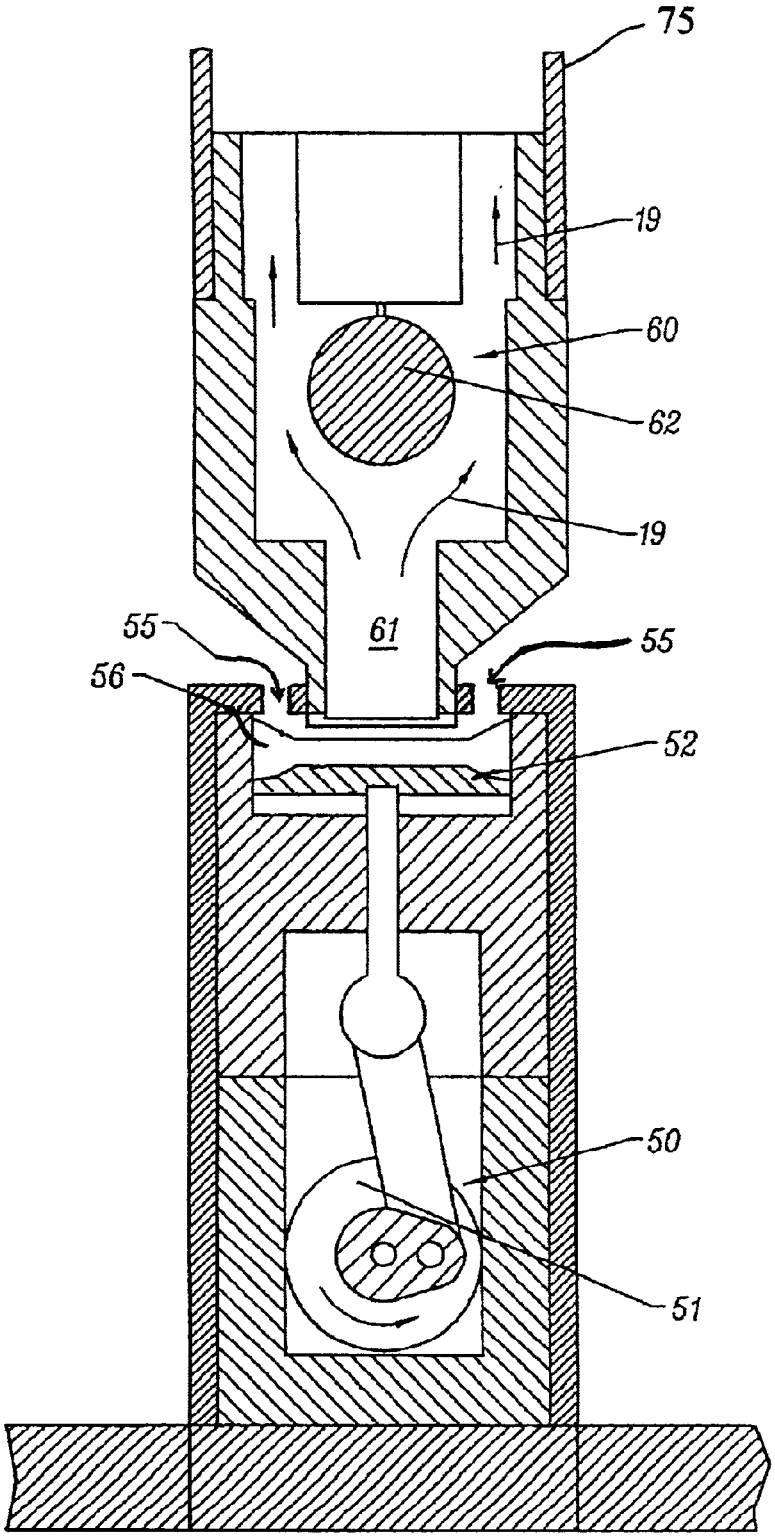
FIG. 8 is a sectional view showing in greater detail the region circled in FIG. 1 which includes one embodiment of a diaphragm pump and the check valve.

FIG. 8 illustrates one embodiment of diaphragm pump 50 which includes an eccentric drive arm 51 which causes oscillation of diaphragm member 52. Alternate pump designs are shown and described below. As diaphragm member 52 moves upwardly, it forces sand into passageway 61, causing ball valve 60 to open by ball 62 moving upwardly, allowing sand to move upwardly through conduit 75 as shown by arrows 19. Diaphragm pump 50 has a sand inlet 55 which cooperates with a circular flap one way check valve 56 to allow sand into the pumping chamber as the diaphragm 52 moves downwardly. Check valve 56 closes the sand inlet 55 as diaphragm 52 is driven upwardly, preventing sand from being pumped back into the sand collection cavity 41.

FIG. 1 illustrates a moisture sensor 80 positioned in vertical conduit 75. The purpose of moisture sensor 80 is to detect the moistness of sand being pumped upwardly by diaphragm pump 50. If the sand is too dry and its moisture level falls below a predetermined level, a water supply tube 90 having a water supply valve 91 carried by conduit 75 is actuated and water is introduced into conduit 75 through the water feed tubing 90 to moisten the sand, to reduce the friction caused between the sand and conduit 75 as well as to reduce dust formation. Moistening the sand in this fashion reduces airborne dust.

Figure 9:
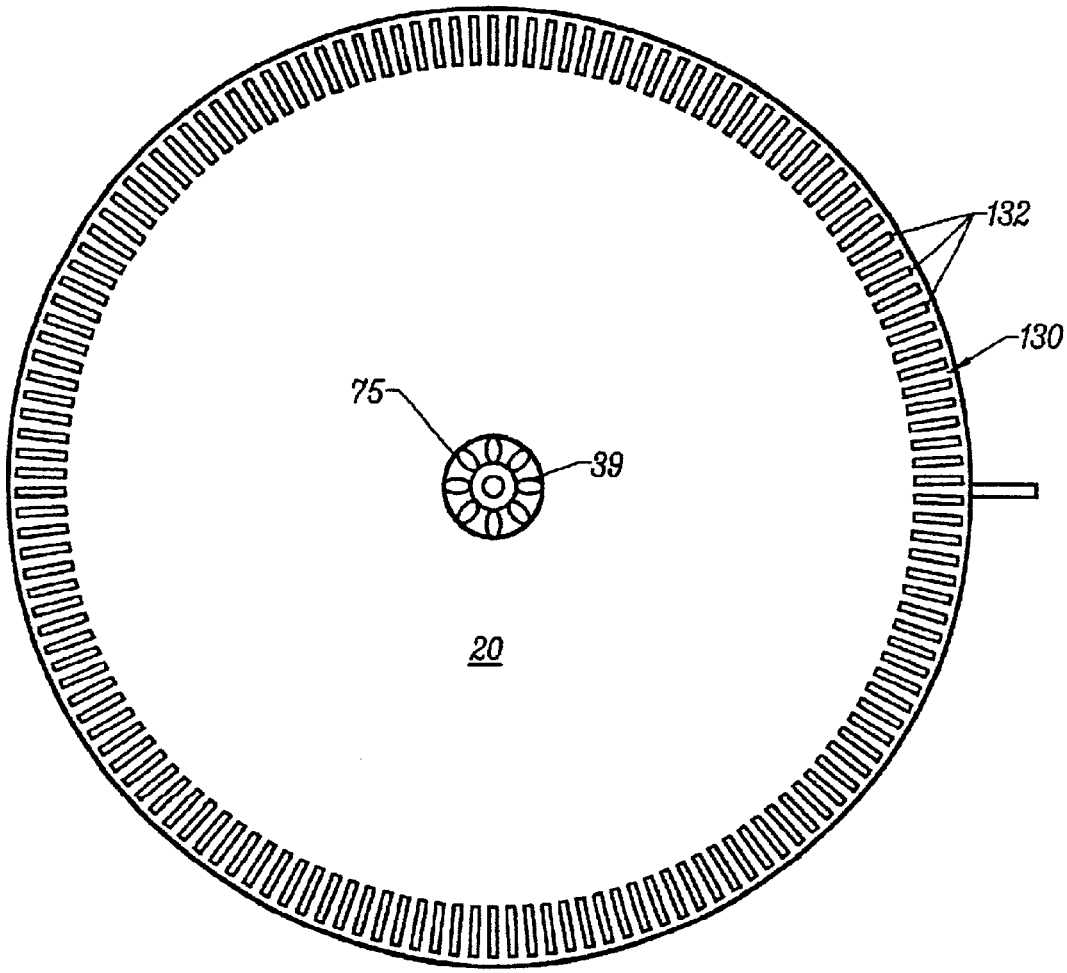
FIG. 9 is a plan view of the support deck with an alternate pattern of drain openings.

FIG. 9 illustrates deck 20 having an alternate design of slots 132 formed therein. Slots 132 are each single, radially extending, elongated slots formed around the periphery of deck 20.

Figure 10:
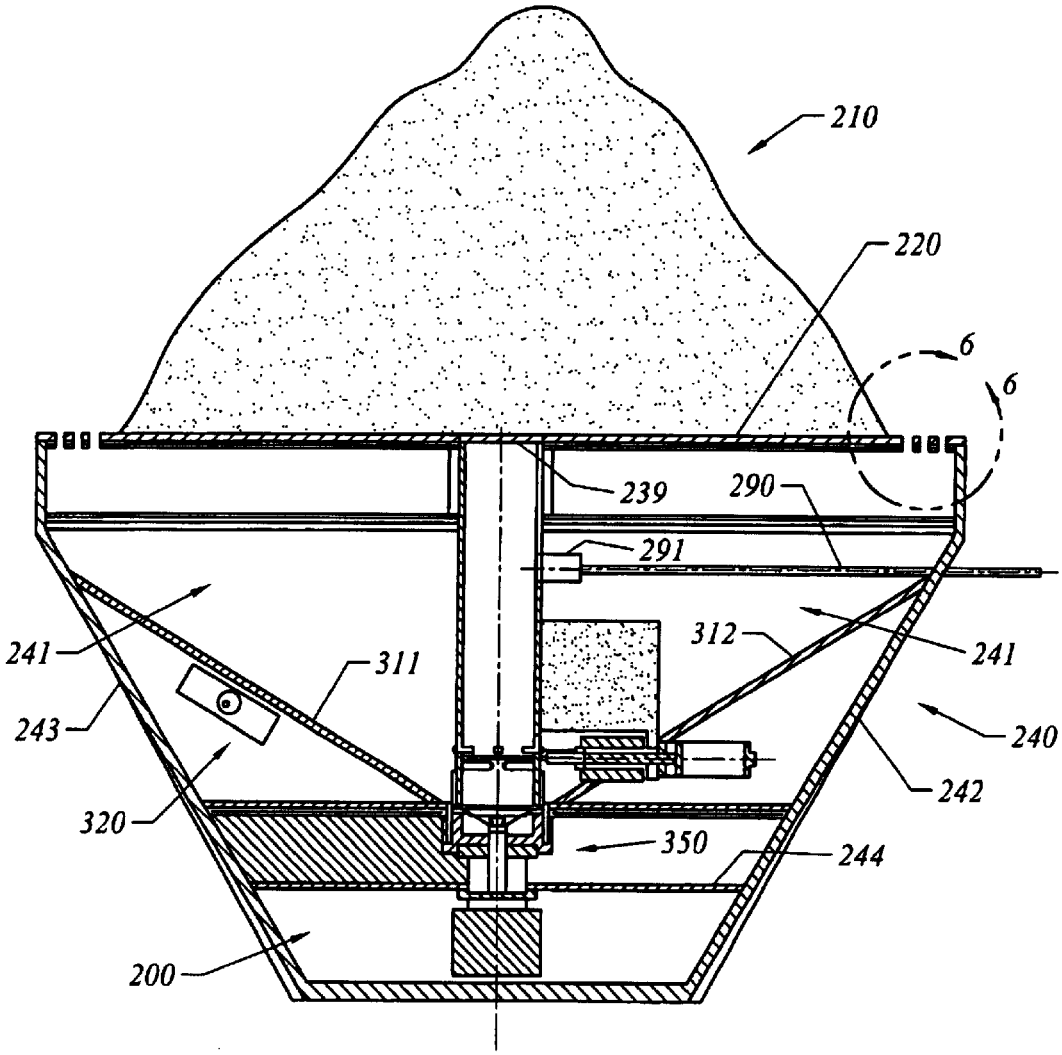
FIG. 10 is a schematic representation of a second embodiment of the invention utilizing an alternate pump design and utilizing resilient inclined walls for supporting sand in the collection chamber, wherein the supporting inclined walls are vibrated to fluidize the sand.

FIG. 10 illustrates a second embodiment of the invention. The significant differences of the second embodiment of FIG. 10 compared with the embodiments of FIGS. 1–9 are twofold: first, an improved diaphragm pump 350 is provided and, second, inclined sand support surfaces or side walls 311 and 312 are utilized, which surfaces are capable of being vibrated to fluidize the sand.

FIGS. 11–17 illustrate the second form of pumping mechanism referred to generally as 350 in the drawings. The pumping mechanism shown in FIGS. 11–17 is preferably used to pump wet or dry sand in a vertically upward direction. The pump 350 shown in the drawings can also be used to pump sand or other particulate matter in any upward direction and, for that matter, could be used to pump sand or particulate matter horizontally. However, for use in conjunction with a restorable sand pile, the pumping mechanism is utilized most advantageously if it is oriented to pump the sand in a substantially vertical direction.

Figure 11:
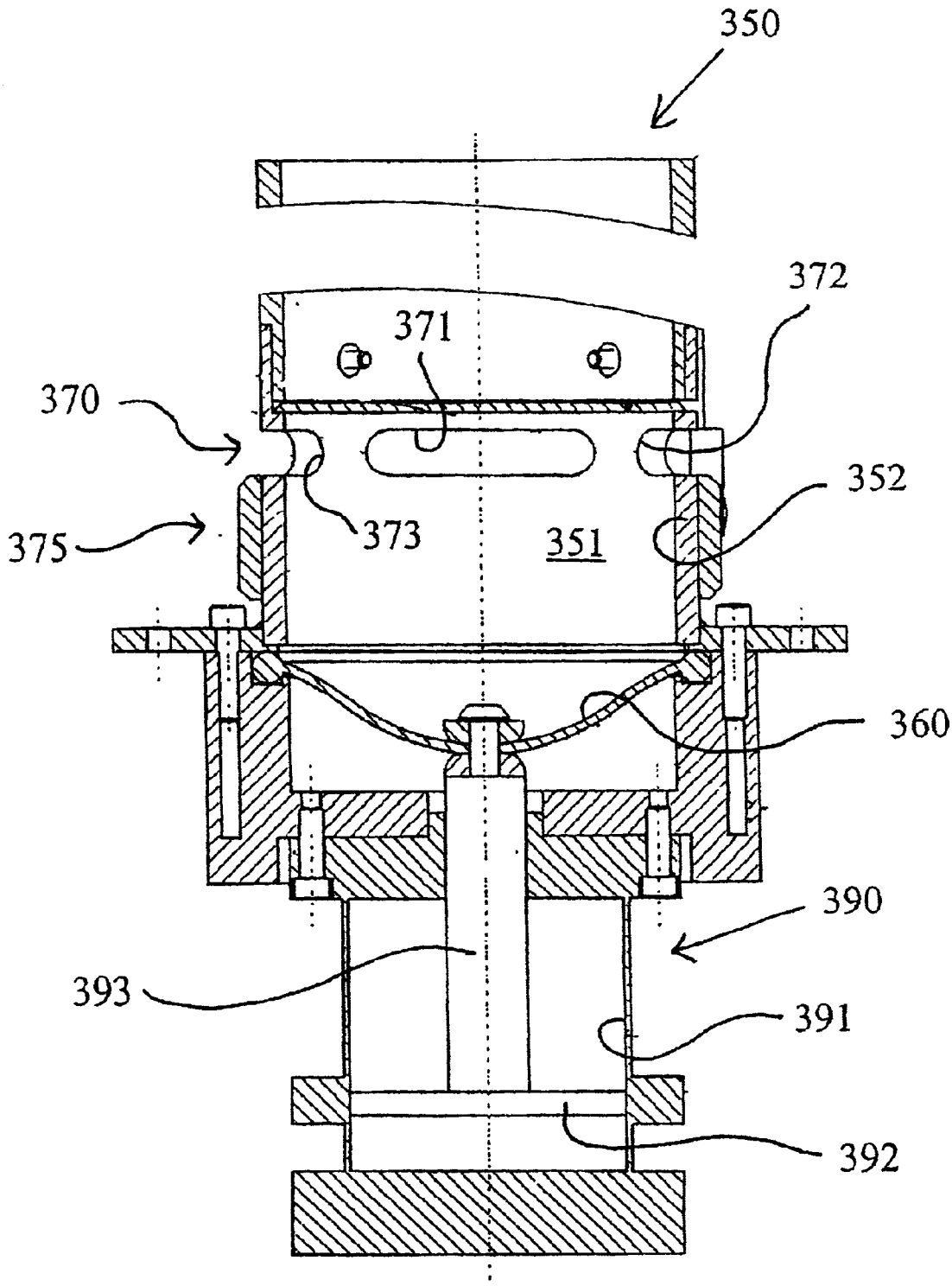
FIG. 11 is a sectional view of the alternate form of diaphragm pump shown in FIG. 10 wherein the diaphragm is shown in its first or lower position.

As shown in FIG. 11, pumping chamber 351 is a generally cylindrical chamber formed by cylindrical walls 352. The bottom of pumping chamber 351 is formed by movable diaphragm 360. Diaphragm 360 is illustrated in FIG. 11 in its first or lower position. Intake means shown generally as 370 comprises four elongated orifices 371,372,373 and a fourth orifice not visible in FIG. 11. Each of the four orifices is formed in walls 352 at approximately the same vertical distance above diaphragm 360. The intake orifices form the upper portion of pumping chamber 351. When diaphragm 360 is in its first or lower position, as illustrated in FIG. 11, intake means 370 is in its open position wherein sand is free to enter orifices 371–373 and fill pumping chamber 351 with sand. Diaphragm 360 is pulsed upwardly from its position shown in FIG. 11 to approximately ¼ of its full upward throw (shown in FIG. 12) several times to help sand move into chamber 351.

Figure 12:
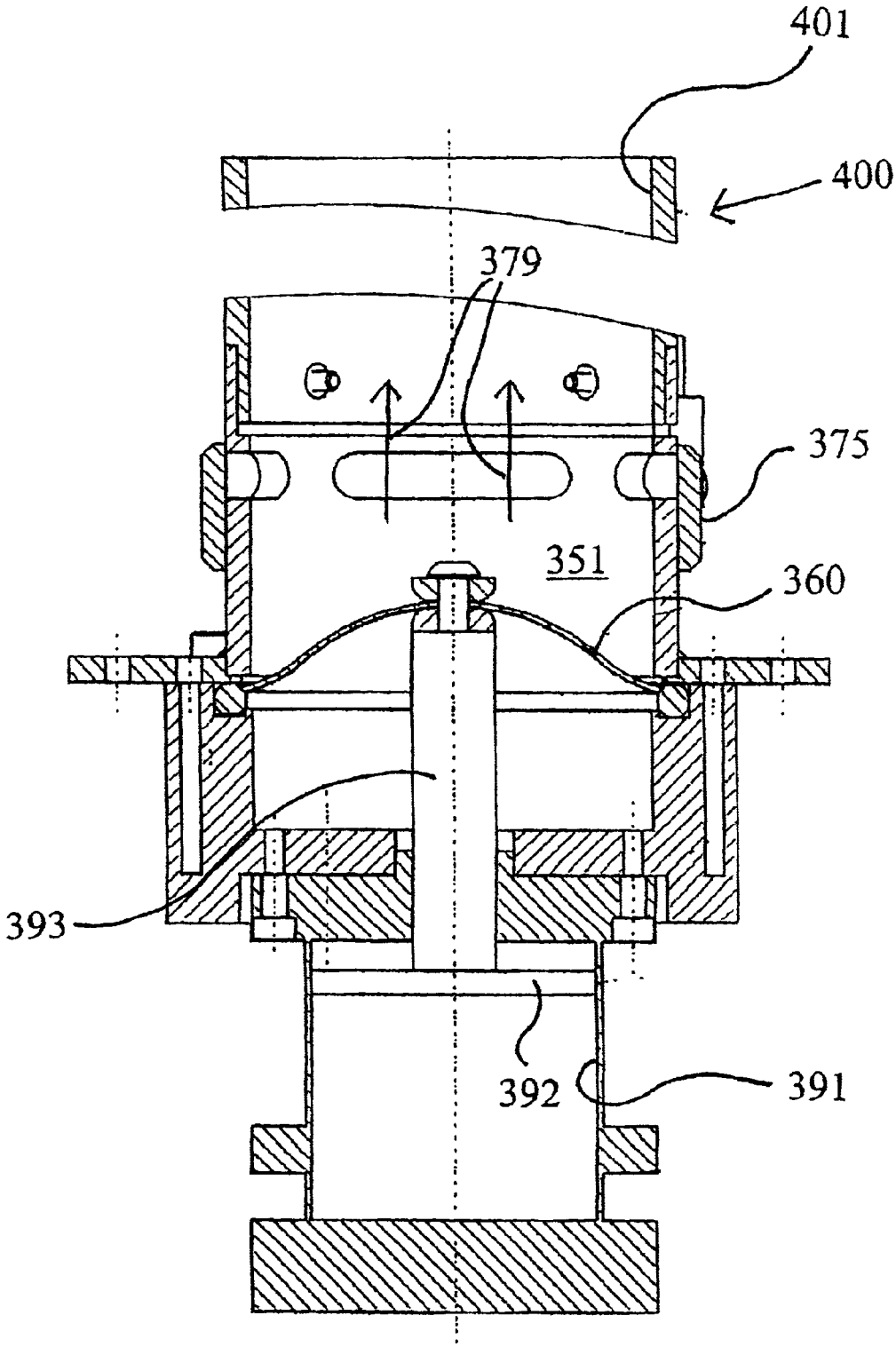
FIG. 12 is a sectional view of the pump shown in FIGS. 10 and 11 wherein the diaphragm is shown in its second or uppermost position wherein sand has been pumped into the outlet pipe.

As shown in FIG. 12, diaphragm 360 is shown in its second or upper position. Before diaphragm 360 begins to move upwardly from its position shown in FIG. 11, intake closure means 375 is moved from its open position shown in FIG. 11 wherein sand may enter pumping chamber 351 to its closed position shown in FIG. 12 wherein intake closure means 375 covers the orifices 371–373 and thereby prevents sand from entering pumping chamber 351. After the intake closure means 375 is moved to its closed position shown in FIG. 12, diaphragm 360 is driven upwardly, causing sand in pumping chamber 351 to be forced upwardly out of pumping chamber 351 as illustrated by arrows 379. Driving means 390 is provided for causing diaphragm 360 to move between its first or lower and second or upper positions. Driving means 390 includes a pneumatic cylinder 391 and a pneumatic piston 392. The pneumatic lines and fittings for causing piston 392 to move in cylinder 391 are well-known in the art and are not illustrated in the drawings in the interest of clarity. Piston 392 is connected to a drive shaft 393 which in turn is connected to diaphragm 360. Alternate forms of driving means are within the scope of the present invention. For example, instead of using a pneumatic cylinder and piston, a crankshaft and connecting rod may be utilized wherein the connecting rod is physically attached to diaphragm 360 and rotation of the crankshaft causes diaphragm 360 to move between its first or lower position and its second or upper position.

Figure 15:
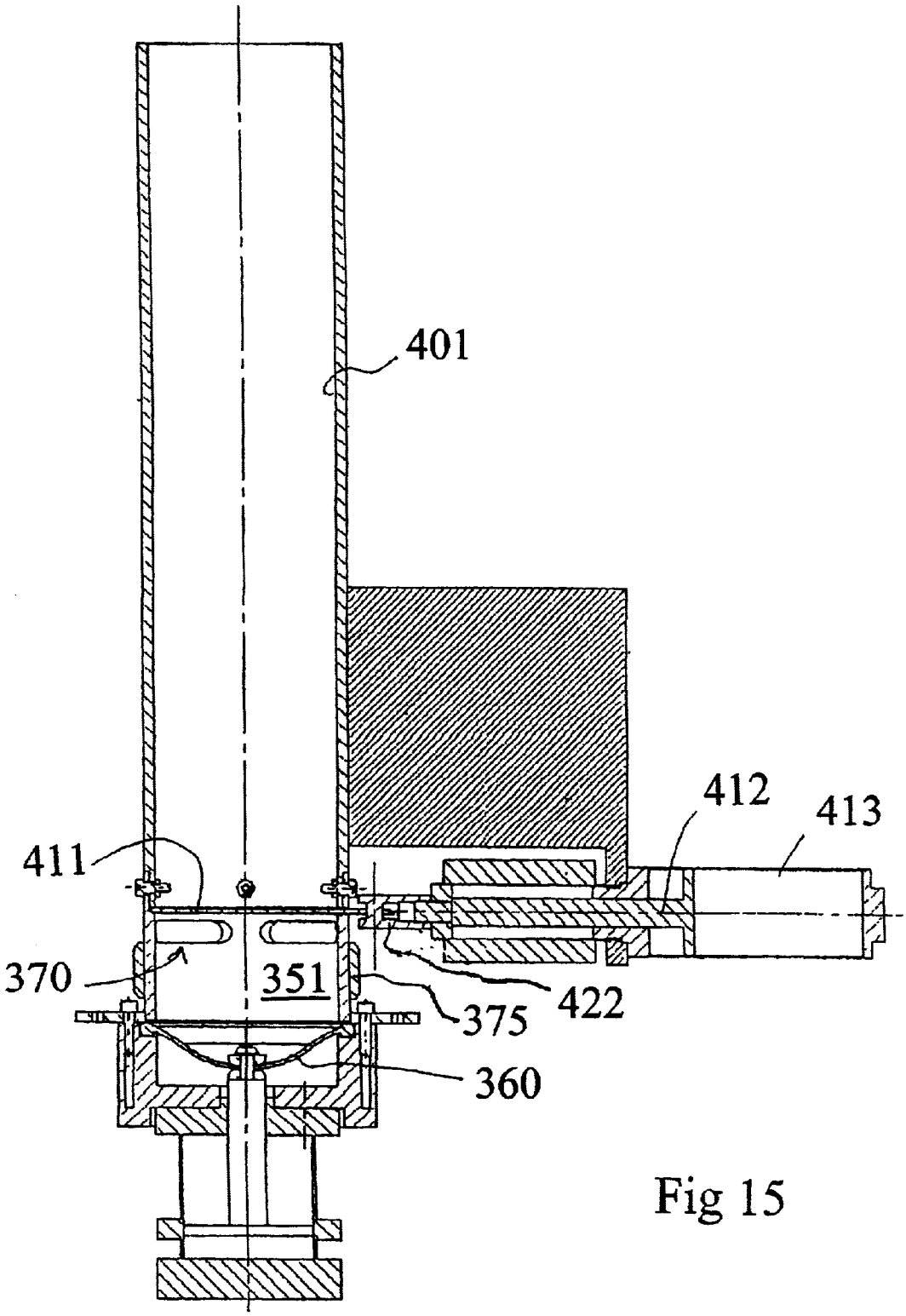
FIG. 15 is a sectional view of the apparatus of FIG. 14 wherein the outlet cover plate 411 is shown in its closed position wherein sand is prevented from flowing backwards from the outlet pipe into the pumping chamber.

Sand being pumped upwardly out of pumping chamber 351 in the direction of arrows 379 enters outlet means 400 which, in the preferred embodiment, is a substantially vertically oriented cylindrical outlet pipe 401. In order to prevent sand from backflowing into pumping chamber 351 from outlet means 400, a sand backflow prevention means 410 (FIG. 14) is provided. Backflow prevention means 410 includes a movable plate 411 (see also FIG. 13). Plate 411 is movable between a first position illustrated in FIGS. 13 and 14 in which plate 411 does not restrict the outlet pipe 401 and sand may be pumped upwardly into outlet 401 by diaphragm 360. Plate 411 is connected to a pneumatic piston 412 carried by pneumatic cylinder 413. As shown best in FIG. 15, when pneumatic piston 412 is moved from its first position shown in FIGS. 13 and 14 to its second position illustrated in FIG. 15, it drives plate 411 through slot 402 in outlet pipe 401 and completely blocks outlet pipe 401 as illustrated in FIG. 15. In the closed position shown in FIG. 15, sand is not able to fall or flow backwardly into pumping chamber 351. Plate 411 is moved to its position illustrated in FIG. 15 when diaphragm 360 is in its upper or second position illustrated in FIG. 12. Before diaphragm 360 is moved to its lower or first position illustrated in FIG. 15, intake closure means 375 is moved to its open position shown in FIG. 15. Diaphragm 360 is thereafter moved to its first or lower position and, as it moves in that direction, sand is free to flow into intake means 370 and the cycle is repeated.

Figure 13:
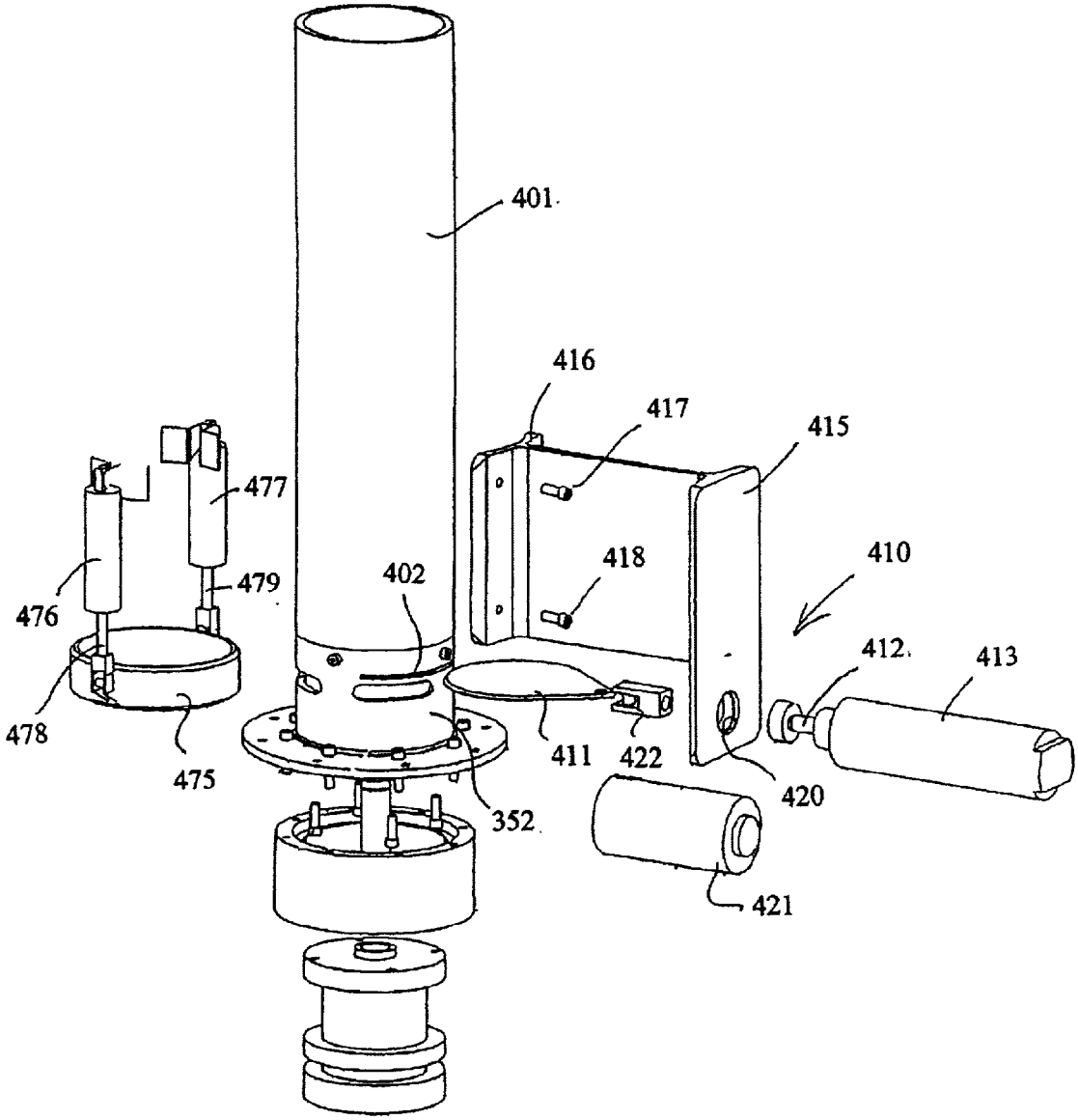
FIG. 13 is an exploded perspective view of the pump illustrated in FIGS. 10, 11 and 12 and which also includes additional elements beyond those shown in FIGS. 10, 11 and 12.
Figure 14:
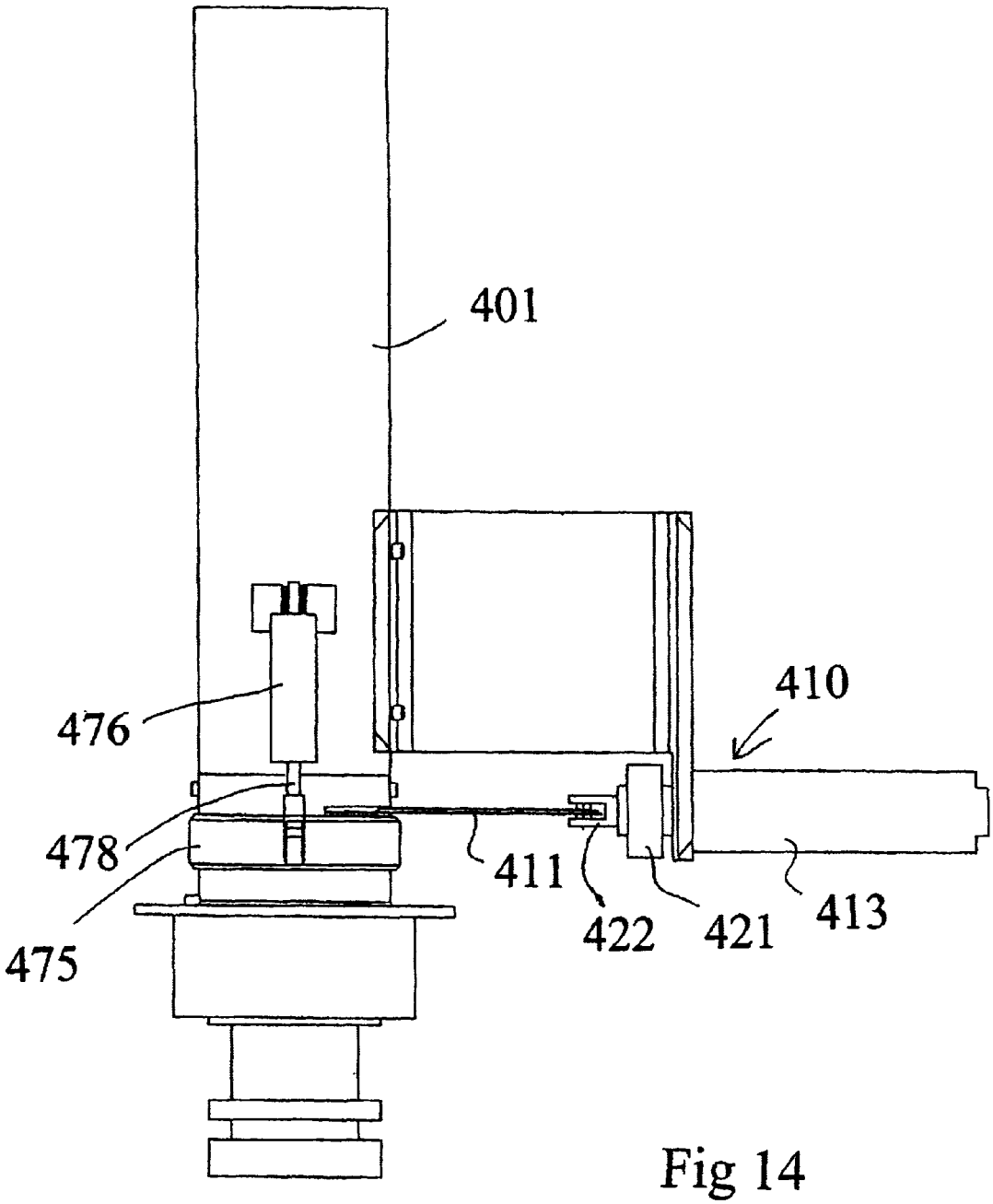
FIG. 14 is a side elevational view of the assembled components shown in FIG. 13 wherein the outlet cover plate is retracted so sand may be pumped into the outlet pipe.

As shown best in FIG. 13, the sand backflow prevention means 410 includes a mounting bracket 415 having a first arcuate mounting flange 416 which is attached to outlet pipe 401 by screws or bolts 417 and 418. Bracket 415 supports pneumatic cylinder 413. Pneumatic piston 412 extends through passageway or hole 420 formed in bracket 415. Piston 412 slides through a protective sleeve 421. Sleeve 421 prevents sand from interfering with piston 412. Piston 412 is connected to a clevis 422 which in turn is connected to plate 411.

As shown best in FIG. 13, intake closure means 475 is a cylindrical section of pipe adapted to slide up and down with respect to the outer surface of cylinder 352 which forms the side wall of pumping chamber 351. Intake closure means 475 is moved between its open and closed positions by intake actuator means 480 comprising a pair of pneumatic cylinders 476 and 477 which have pistons 478 and 479, respectively, which are connected to and cause closure means 475 to move between its open and closed positions.

Figure 16:
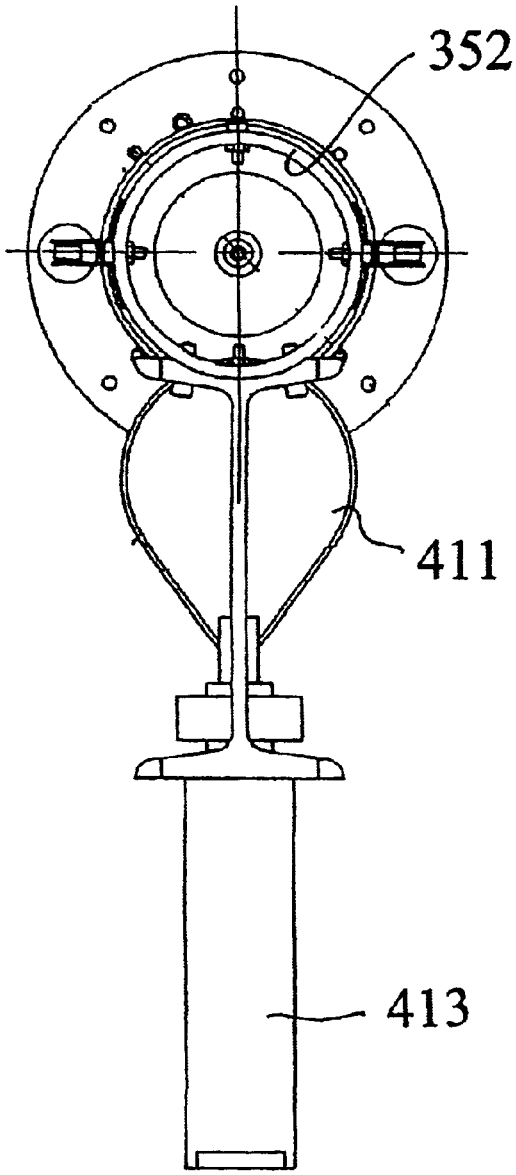
FIG. 16 is a top plan view of the pump apparatus of FIG. 15 showing the cover plate in its retracted position.
Figure 17:
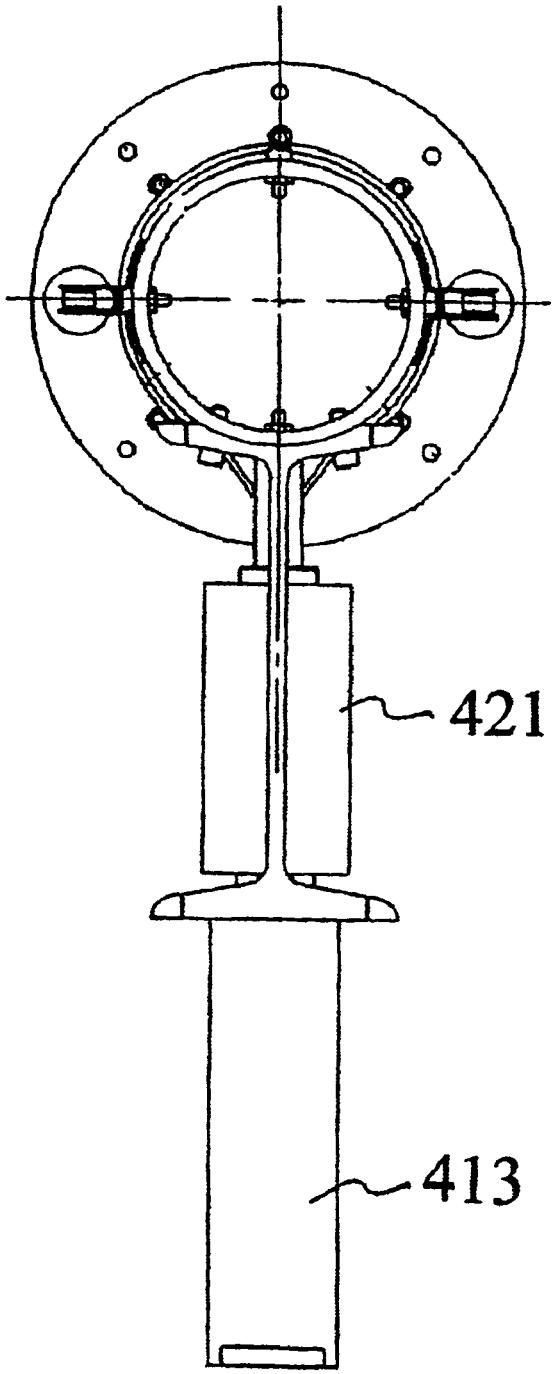
FIG. 17 is a top plan view showing the cover plate in its closed position.

FIGS. 16 and 17 are top views illustrating the motion of plate 411 between its open position shown in FIG. 16 and its closed position shown in FIG. 17.

FIG. 10 illustrates the use of resilient, inclined side walls 311 and 312 of collection chamber 241. Resilient side walls 311 and 312 are periodically vibrated by vibration means 320. The vibration causes the sand sitting on walls 311 and 312 to become fluidized and to flow more easily into the intake means 370 of diaphragm pump 350. Vibration means 320 comprises in one embodiment a rotating eccentric 321 connected to or carried by wall 311 that imparts vibration into resilient side wall 311. Other vibrators may alternately be used.

Figure 18:
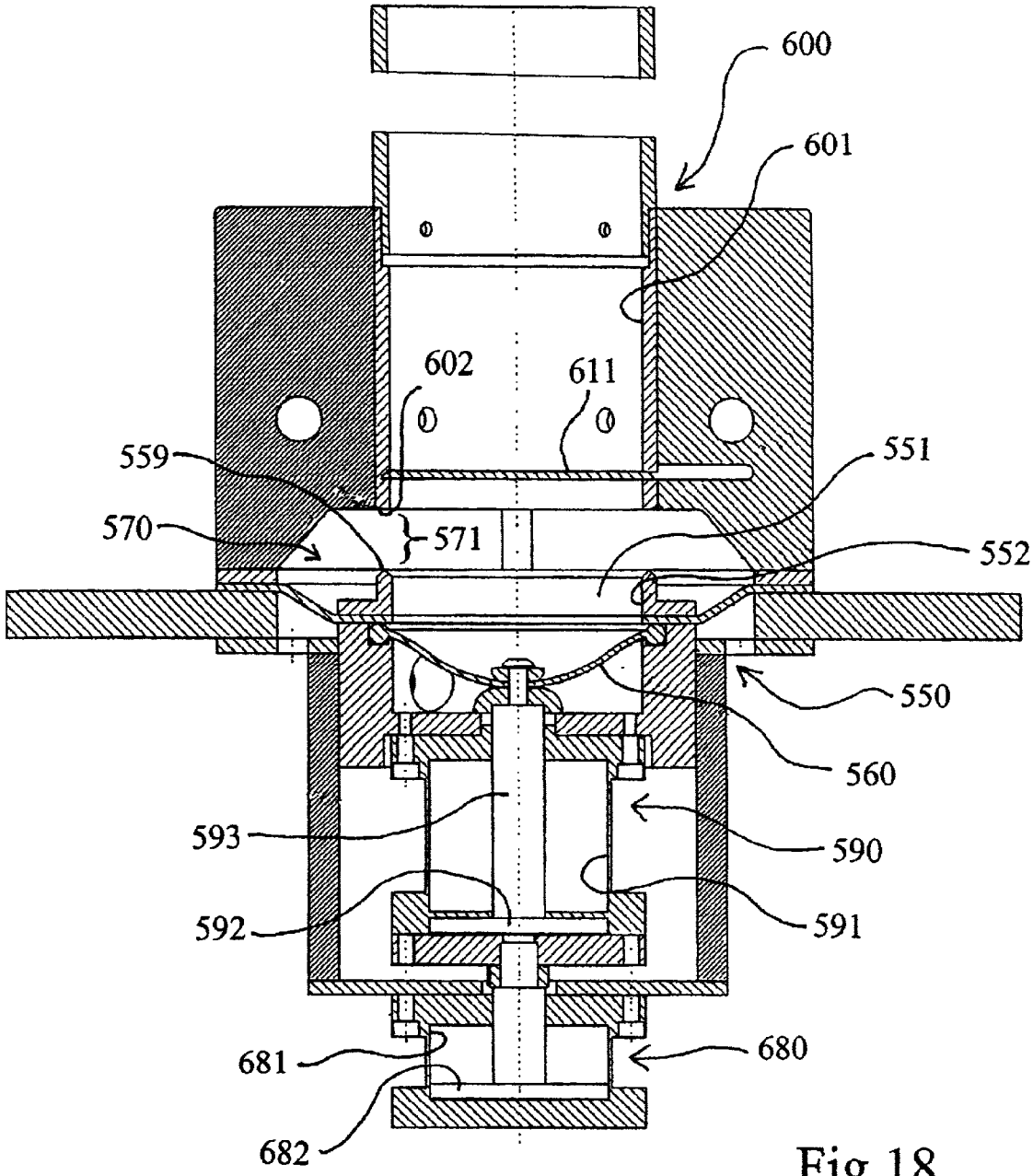
FIG. 18 is a sectional view of a third diaphragm pump design, which is the preferred design, wherein the diaphragm is shown in its first or lower position.

FIGS. 18–22 illustrate a third form of pumping mechanism referred to generally as 550 in the drawings. The pumping mechanism 550 illustrated in FIGS. 18–22 and described below is the preferred embodiment of the invention. Pumping chamber 551 is a generally cylindrical chamber formed by cylindrical walls 552. The bottom of pumping chamber 551 is formed by movable diaphragm 560. Diaphragm 560 is illustrated in FIG. 18 in its first or lower position. Intake means shown generally as 570 comprises an open mouth 571. Open mouth 571 extends vertically between the top edge 559 of cylindrical wall 552 and the bottom edge 602 of outlet pipe 601, outlet pipe 601 forming the outlet means 600 for receiving sand pumped upwardly by pump mechanism 550. Sand flows freely into open mouth 571 when the pumping mechanism is in the position illustrated in FIG. 18.

Figure 19:
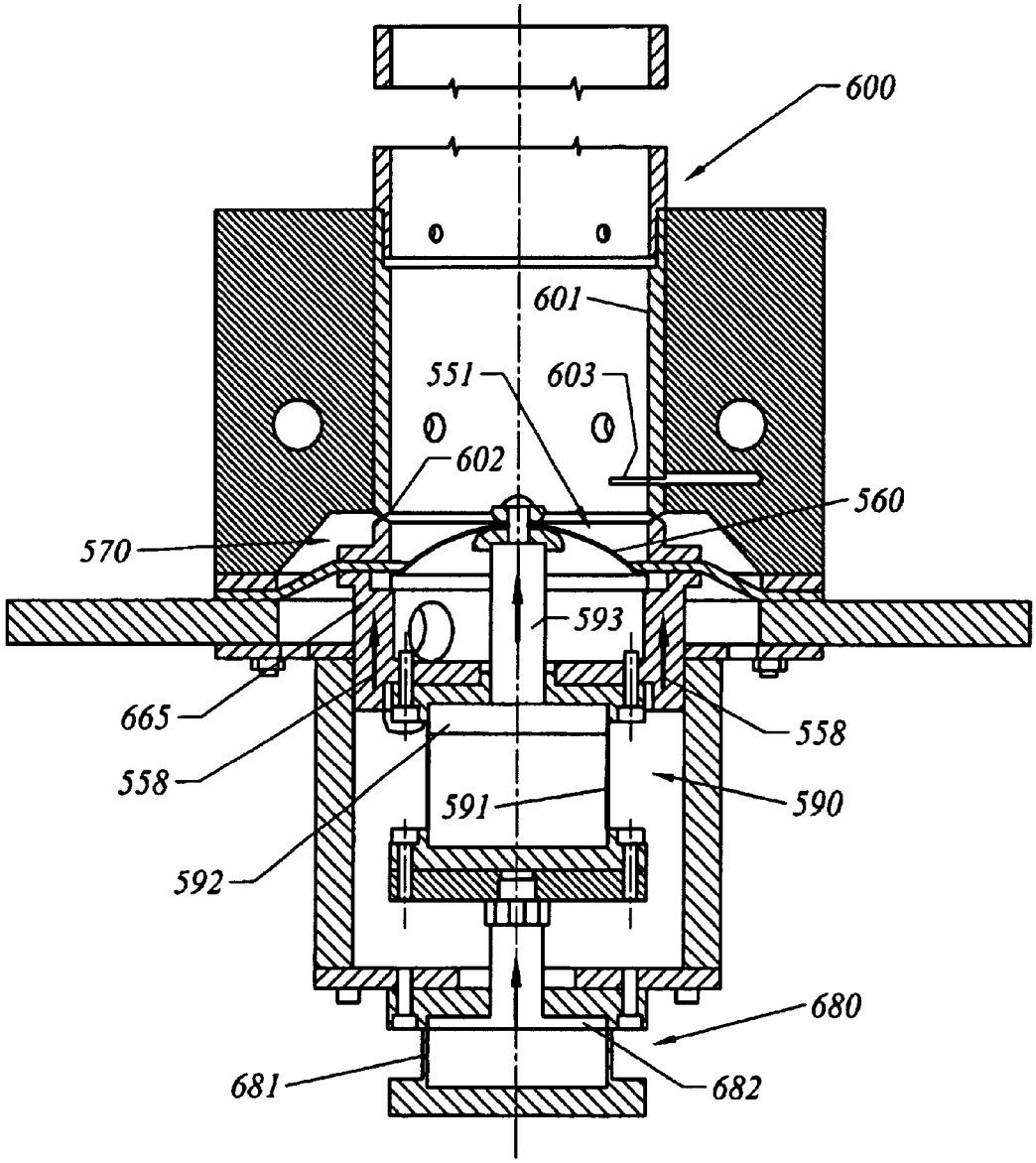
FIG. 19 is a sectional view of the pump shown in FIG. 18 wherein the diaphragm is shown in its second or uppermost position.

As shown in FIG. 19, diaphragm 560 is shown in its second or upper position. Before diaphragm 560 begins to move upwardly from its position shown in FIG. 18, intake means 570 is moved from its open position in FIG. 18 to its closed position shown in FIG. 19 wherein the upper edge 559 of cylindrical wall 552 has been driven upwardly in the direction of arrows 558 by intake actuator means 680 to the position shown in FIG. 19 where it seats against the lower surface 602 of cylindrical outlet pipe 601. Upper edge 559 of wall 552 and the lower surface 602 of outlet pipe 601 form an intake closure means. In the closed position of intake means 570 illustrated in FIG. 19, sand is prevented from entering pumping chamber 551. After intake means 570 is moved to its closed position shown in FIG. 19, diaphragm 560 is driven upwardly, causing sand in pumping chamber 551 to be forced upwardly out of pumping chamber 551.

Diaphragm 560 is caused to move by driving means 590. Driving means 590 includes a pneumatic cylinder 591 and pneumatic piston 592. The pneumatic lines and fittings for causing piston 592 to move in cylinder 591 are well known in the art and are not illustrated in the interest of clarity. Piston 592 is connected to a drive shaft 593 which in turn is connected to diaphragm 560.

Figure 20:
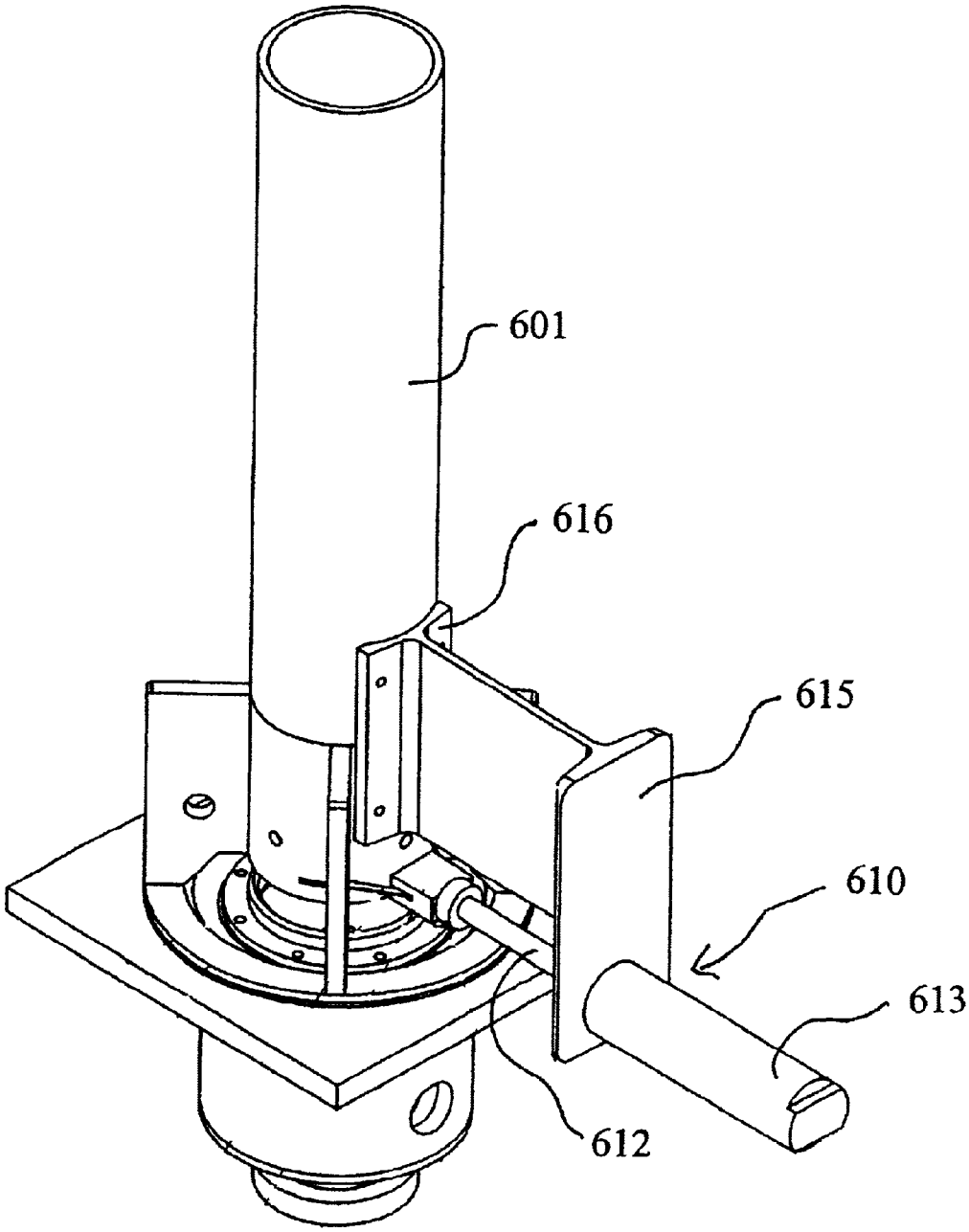
FIG. 20 is a perspective view of the pump shown in FIGS. 18 and 19, and includes elements not shown in FIGS. 18 and 19.
Figure 21:
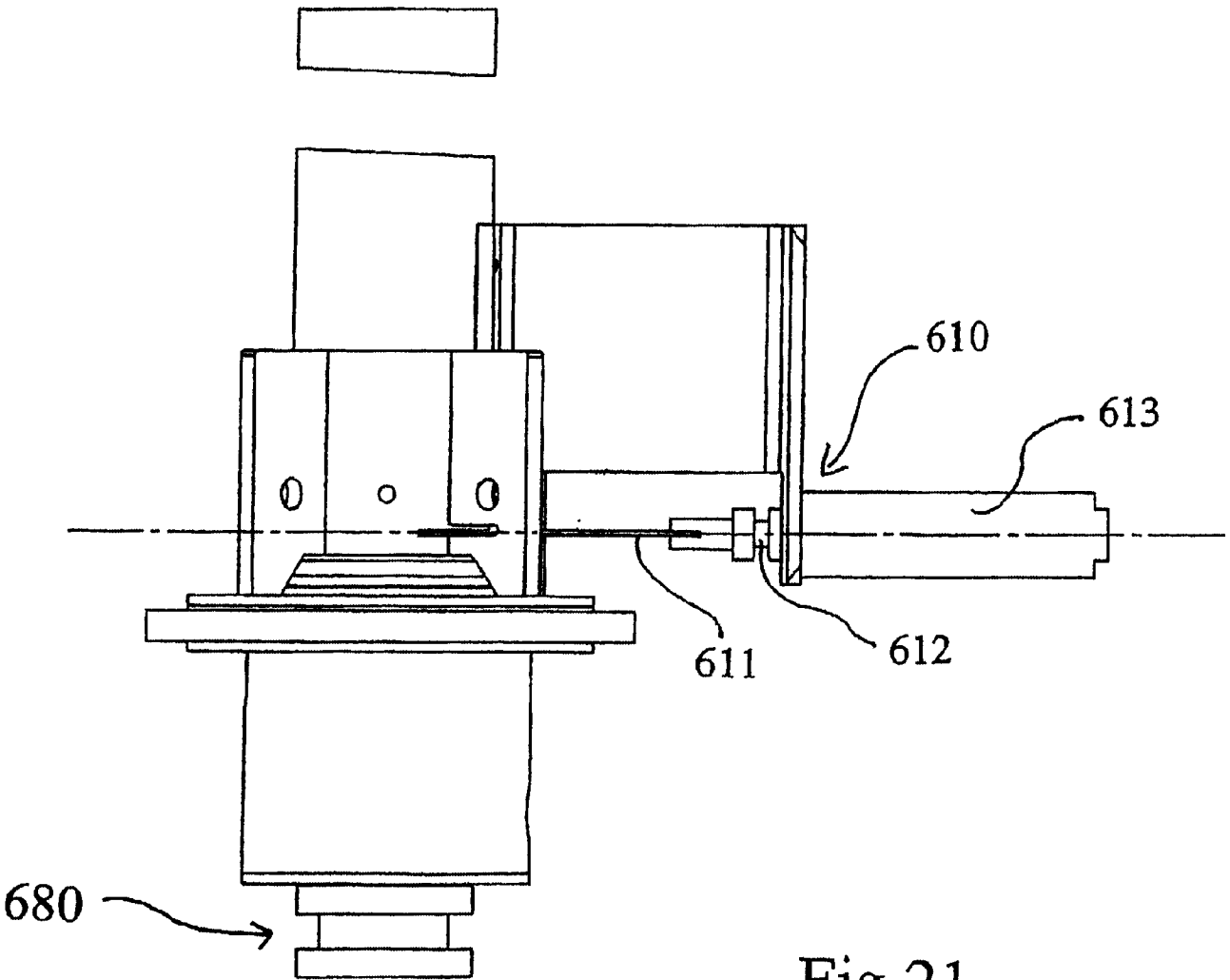
FIG. 21 is a side elevational view of the pump shown in FIG. 20 wherein the outlet cover plate is retracted so sand may be pumped into the outlet pipe.
Figure 22:
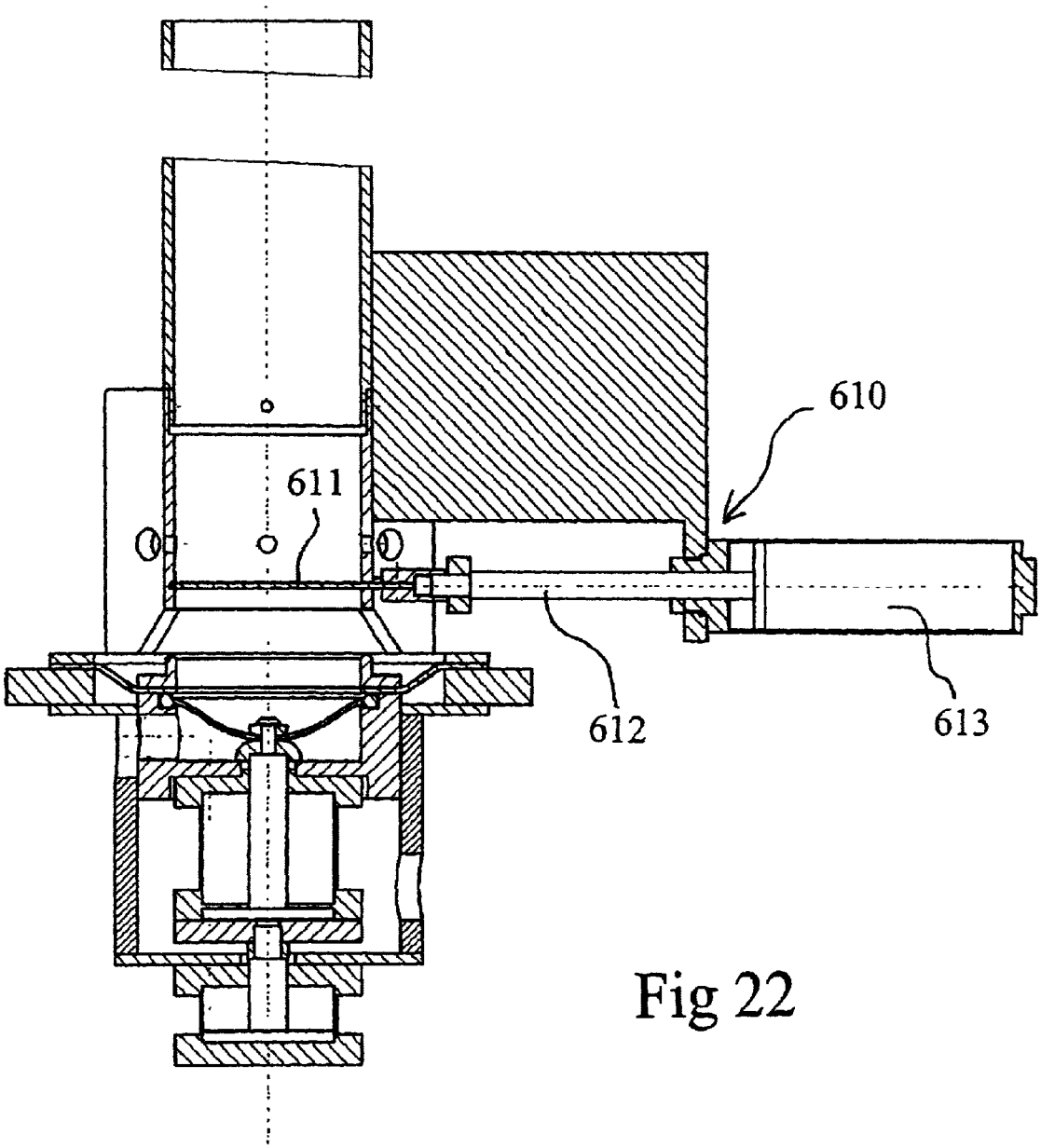
FIG. 22 is a sectional view of the pump shown in FIG. 20 wherein the outlet cover plate is shown in its closed position wherein sand is prevented from flowing backwards from the outlet pipe into the pumping chamber.

Sand being pumped upwardly out of pumping chamber 551 enters outlet means 600 which is a substantially vertically oriented cylindrical outlet pipe 601. In order to prevent sand from backflowing into pumping chamber 551, a sand backflow prevention means 610 is provided which is substantially the same backflow prevention means as 410, illustrated in FIGS. 12–15 and described above. Backflow prevention means 610 (FIGS. 20–22) includes a movable plate 611 (FIGS. 18,21,22). Plate 611 is movable between a first position illustrated in FIG. 21 in which plate 611 does not restrict the outlet pipe 601 and sand may be pumped upwardly into outlet 600 by diaphragm 560. Plate 611 is connected to a pneumatic piston 612 carried by pneumatic cylinder 613. When pneumatic piston 612 is moved from its first position illustrated in FIG. 21 to its second position illustrated in FIGS. 18, 20 and 22, it drives plate 611 through slot 603 in outlet pipe 601 and completely blocks outlet pipe 601 as illustrated in FIGS. 18, 20 and 22, so that sand is not able to fall or flow backwardly into pumping chamber 551. Plate 611 is moved to its closed position when the diaphragm 560 is in its upper or second position illustrated in FIG. 19.

Sand backflow prevention means 610 includes a mounting bracket 615 having a first arcuate mounting flange 616 attached to outlet pipe 601 by screws or bolts. Bracket 615 supports pneumatic cylinder 613 and piston 612.

As shown best in FIGS. 18 and 19, intake actuator means 680 comprises a pneumatic cylinder 681 and a pneumatic piston 682. Intake actuator means 680 causes intake means 570 to move between its open position illustrated in FIG. 18 and its closed position in FIG. 19. Pneumatic piston 682 is caused to move from its lowermost position in FIG. 18 to its uppermost position shown in FIG. 19 whereby piston 682 causes the diaphragm assembly to move upwardly in the direction of arrows 558 as shown in FIG. 19. The diaphragm assembly includes diaphragm 560 as well as the supporting cylindrical member 665 which carries diaphragm 560. Pneumatic cylinder 591 is also driven upwardly by intake actuator means 680. Alternate forms of actuators may be used instead of the pneumatic cylinder and piston arrangement for intake actuator means 680. For example, a rotating crankshaft and connecting rod may be utilized. The pneumatic fittings and lines causing piston 682 to move are not shown in the interest of clarity. Such fittings and lines are well-known in the art.

It is within the scope of the invention to mount the apparatus on a trailer or a truck chassis so that the device is readily transportable to birthday parties and other similar functions where an amusement device is desirable.

The foregoing description of the invention has been presented for purposes of illustration and description and is not intended to be exhaustive or to limit the invention to the precise form disclosed. Modifications and variations are possible in light of the above teaching. The embodiments were chosen and described to best explain the principles of the invention and its practical application to thereby enable others skilled in the art to best use the invention in various embodiments and with various modifications suited to the particular use contemplated. The scope of the invention is to be defined by the following claims.

What is claimed is:

1. A restorable sand or pellet pile usable as an amusement, exercise or training device, comprising:

a sand or pellet collection chamber having inclined side walls that converge toward each other in a downward direction, a support deck for sand or pellets positioned above said collection chamber, a safety grating formed around the perimeter of said support deck adapted to allow sand or pellets to flow downwardly therethrough into said collection chamber, and pump means for pumping sand or pellets upwardly from said collection chamber onto said support deck.

2. The apparatus of claim 1 wherein said pump means comprises a diaphragm pump and check valve.

3. The apparatus of claim 2 further comprising a conduit extending vertically from said diaphragm pump through said support deck.

4. The apparatus of claim 1 wherein said support deck is circular and wherein said collection chamber has a truncated conical shape.

5. The apparatus of claim 4 wherein said grating comprises a plurality of elongated, radially extending slots formed near the periphery of said deck.

6. The apparatus of claim 4 further comprising a moisture sensor for sensing moisture in said sand or pellets in said conduit.

7. The apparatus of claim 6 further comprising a water supply line and water supply valve carried by said vertically extending conduit, whereby water may be added to said conduit if the moisture sensed by said sensor falls below a predetermined level.

8. The apparatus of claim 1 wherein said pump means comprises:

a substantially vertically oriented pumping chamber, a diaphragm mounted in said pumping chamber, said diaphragm movable between a lower position wherein sand or pellets enter said pumping chamber and an upper position wherein sand or pellets are pumped upwardly out of said pumping chamber, driving means for causing said diaphragm to move between said lower and upper positions, intake means for allowing sand or pellets to enter said pumping chamber, intake closure means for periodically closing said intake means, said intake closure means moving between an open position wherein sand or pellets enter said pumping chamber and a closed position wherein sand or pellets are prevented from entering said pumping chamber, intake actuator means for causing said intake closure means to move between said open and closed positions, outlet means extending upwardly from said pumping chamber for receiving sand or pellets pumped upwardly from said pumping chamber by said diaphragm, and backflow prevention means for closing said outlet means when said diaphragm is in its upper position to prevent sand or pellets from falling into said pumping chamber and for opening said outlet means when said diaphragm is in its lower position to allow sand or pellets to be pumped into said outlet means as said diaphragm moves from its lower position to its upper position.

9. The apparatus of claim 8 wherein said intake means is positioned at the top of said pumping chamber whereby sand or pellets flow through said intake means and fall onto said diaphragm by gravity.

10. The apparatus of claim 9 wherein said pumping chamber has cylindrical walls, and said intake means comprises an opening formed in said cylindrical wall, and further comprises a cover mounted on said cylindrical wall, said cover moving between a closed position in which it seals said opening to prevent sand or pellets from flowing therethrough, and an open position in which sand or pellets flow through said opening.

11. The apparatus of claim 8 wherein said inclined side walls of said collection chamber are resilient, and further comprising:

vibration means connected to said inclined side walls to vibrate said inclined side walls to fluidize said sand or pellets and to cause said fluidized sand or pellets to flow more easily toward said pump means.

12. The apparatus of claim 11 wherein said vibration means is a rotating eccentric carried below said inclined side walls.

13. The apparatus of claim 8 wherein said driving means for moving said diaphragm comprises a pneumatic cylinder and piston assembly.

14. The apparatus of claim 8 wherein said driving means for moving said diaphragm comprises a rotating crank and a connecting rod extending from said crank to said diaphragm.

15. A pump for pumping wet or dry sand upwardly, comprising:

a substantially vertically oriented pumping chamber, a diaphragm mounted in said pumping chamber, said diaphragm movable between a lower position wherein sand enters said pumping chamber and an upper position wherein sand is pumped upwardly out of said pumping chamber, driving means for causing said diaphragm to move between said lower and upper positions, intake means for allowing sand to enter said pumping chamber, said intake means moving between an open position wherein sand enters said pumping chamber and a closed position wherein sand is prevented from entering said pumping chamber, intake actuator means for causing said intake means to move between said open and closed positions, outlet means extending upwardly from said pumping chamber for receiving sand pumped upwardly from said pumping chamber by said diaphragm, and sand backflow prevention means for closing said outlet means when said diaphragm is in its upper position to prevent sand from falling into said pumping chamber and for opening said outlet means when said diaphragm is in its lower position to allow sand to be pumped into said outlet means as said diaphragm moves from its lower position to its upper position.

16. The apparatus of claim 15 wherein said intake means is positioned at the top of said pumping chamber whereby sand flows through said intake means and falls onto said diaphragm by gravity.

17. The apparatus of claim 15 wherein said pumping chamber has cylindrical walls, and said intake means comprises an opening formed in said cylindrical wall, and further comprises a cover mounted on said cylindrical wall, said cover moving between a closed position in which it seals said opening to prevent sand from flowing therethrough, and an open position in which sand flows through said opening.

18. The apparatus of claim 15 wherein said driving means for moving said diaphragm comprises a pneumatic cylinder and piston assembly.

19. The apparatus of claim 15 wherein said driving means for moving said diaphragm comprises a rotating crank and a connecting rod extending from said crank to said diaphragm.

20. The apparatus of claim 15 wherein said outlet means is a cylindrical pipe having a lower surface and wherein said pumping chamber has a cylindrical wall and wherein the upper edge of said cylindrical wall is movable between a closed position where said upper edge seats against said lower surface of said outlet pipe and an open position wherein said upper edge is spaced apart from said lower surface.

21. The apparatus of claim 20 wherein said intake actuator means comprises a pneumatic cylinder and piston which causes said cylindrical wall to move relative to said lower surface of said outlet pipe.

22. A pump for pumping wet or dry sand, comprising:

a pumping chamber, a diaphragm mounted in said pumping chamber, said diaphragm movable between a first position wherein sand enters said pumping chamber and a second position wherein sand is pumped out of said pumping chamber, driving means for causing said diaphragm to move between said first and second positions, intake means for allowing sand to enter said pumping chamber, means for periodically closing said intake means, said means moving between an open position wherein sand enters said pumping chamber and a closed position wherein sand is prevented from entering said pumping chamber, outlet means extending outwardly from said pumping chamber for receiving sand pumped outwardly from said pumping chamber by said diaphragm, and sand backflow prevention means for closing said outlet means when said diaphragm is in its second position to prevent sand from flowing into said pumping chamber and for opening said outlet means when said diaphragm is in its first position to allow sand to be pumped into said outlet means as said diaphragm moves from its first position to its second position.

* * * * *